US005820662A

United States Patent [19]

Kubo et al.

[11] Patent Number: 5,820,662

[45] Date of Patent: Oct. 13, 1998

[54] DENTAL INVESTING MATERIAL

[75] Inventors: Fuminobu Kubo, Katano; Kazuhiko Johshin, Yokosuka, both of Japan

[73] Assignee: Taisei Dental Mfg. Co., Ltd., Japan

[21] Appl. No.: 899,046

[22] Filed: Jul. 23, 1997

[30] Foreign Application Priority Data

Mar. 31, 1997 [JP] Japan ..... 9-098180

[51] Int. Cl.[6] ..... B22C 1/08; H61K 6/00

[52] U.S. Cl. ..... 106/35; 106/38.2; 106/38.3; 106/38.9; 106/692; 106/802; 501/4

[58] Field of Search ..... 106/35, 38.3, 38.2, 106/38.9, 692, 802; 501/4

[56] References Cited

FOREIGN PATENT DOCUMENTS 61-35162 8/1996 Japan .

OTHER PUBLICATIONS

WPIDS Abstract No. 94–307559 which is an abstract of Japanese Patent Specification No. 06–234612 (Aug. 1994).
WPIDS Abstract No. 94–307560 which is an abstract of Japanese Patent Specification No. 06–234613 (Aug. 1994).
Chemical Abstract No. 102:226076 which is an abstract of Japanese Patent Specification No. 60–001109 (Jan. 1985).
Chemical Abstract No. 114:49650 which is an abstract of Japanese Patent Specification No. 02–207010 (Aug. 1990).

*Primary Examiner*—Anthony Green
*Attorney, Agent, or Firm*—Millen, White, Zelano & Branigan, P.C.

[57] ABSTRACT

A dental investing material is disclosed which comprises a combination of: (a) quartz and/or cristobalite, (b) a phosphate binder, and (c) aluminous cement, wherein said dental investing material is further added with tridymite and magnesium silicate. The disclosed dental investing material shows minimized expansion during hardening, significant expansion during heating and develops no cracks when heated at a conventional heating rate.

5 Claims, No Drawings

DENTAL INVESTING MATERIAL

FIELD OF THE INVENTION

The present invention relates to a dental investing material, and is addressed to providing an investing material suitable for dental-use precision casting that causes little expansion during hardening but significantly expands during heating.

BACKGROUND OF THE INVENTION

For a dental investing material (i.e. mold forming materials for dental castings such as crown) used in dental precision casting, it is required that the material show little expansion during hardening around a wax pattern, since a substantial expansion would cause unacceptable deformation in the mold. Likewise, it is also required that such a dental investing material significantly expand during heating, in order to set off later contraction of the alloy cast and cooled in the mold.

There is known a material disclosed as suitable for dental precision casting which is provided by employment either quartz or cristobalite alone or both of them in combination as heat resistant materials, with a phosphate binder and a small amount of aluminous cement added thereto, and which is kneaded with colloidal a silica suspension in use (see Japanese Patent Publication 61-35162).

The above material, containing a small amount of aluminous cement, is suitable for dental-use precision casting with respect to the aspects that it shows a limited rate of expansion during hardening of not more than 0.3% and yet exhibiting a high rate of thermal expansion of 1.4–1.9%. However, due to sharp increases in the rates of thermal expansion of quartz and cristobalite during heating, there has been a problem of crack developed in the mold when it is heated at a conventionally adopted heating rate of 350° C./hr, rendering it unusable.

SUMMARY OF THE INVENTION

It is the objective of the present invention to improve phosphate based investing material containing quartz or cristobalite as a primary ingredient, and thus providing a dental investing material characterized in that the material shows only negligible expansion during hardening but significantly expands during heating, yet causing no cracks when heated at a conventionally adopted heating rate.

The present inventors have found that the above objective is attained by replacing part of said quartz or cristobalite with tridymite, which is a crystal modification of quartz or cristobalite, and further employing magnesium silicate as an additional ingredient.

Therefore, the present invention provides a dental investing material comprising a combination of:

(a) quartz and/or cristobalite, (b) a phosphate binder, and (c) aluminous cement, wherein said dental investing material is further added with tridymite and magnesium silicate.

That is, the dental investing material of the present invention is characterized in that tridymite and magnesium silicate is added to a base dental investing material comprising quartz and/or cristobalite, a phosphate binder and aluminous cement.

The dental investing material of the present invention may be used to form a dental mold through kneading with a colloidal silica suspension. In spite of its remarkable expansion during heating due to the use of quartz or cristobalite for heat resistant materials, it exhibits little expansion during hardening owing to the aluminous cement incorporated, thus causing no deformation of the mold and enabling precision casting. Moreover, tridymite (which shows only slight expansion during heating) added to quartz and cristobalite, which significantly expands during heating, has enabled to ease the slope of the thermal expansion curve without reducing overall expansion during heating, thus allowing melting and incineration of a wax pattern to be conducted at a conventional heating rate without causing cracks, thereby increasing efficiency of a casting process.

With employment of both quartz and cristobalite together with tridymite, i.e. the other form of silica (heat resistant material), the dental investing material of the present invention exhibits reduced expansion during hardening and increased strength, thus being excellent in prevention of cracks and precision of the product.

DETAILED DESCRIPTION OF THE INVENTION

In use, the investing material of the present invention is kneaded with a colloidal silica suspension, poured to invest a wax pattern, allowed to harden, and, after incineration of the wax pattern, supplied for casting of a crown. In the present invention, for silica, which is employed for heat resistance and comprises a chief component of the investing material, tridymite is used together with at least one ingredient selected from quartz and cristobalite. Expansion coefficient of quartz greatly increases at 573° C . Expansion coefficient of cristobalite, on the other hand, greatly increased at about 220° C. Thus, investing materials employing these components enables precision casting by setting off the contraction of poured alloy during cooling and solidification. In particular, employment of both quartz and cristobalite provides better offset against such contraction during cooling. In addition, tridymite, as its increase in the slope of the expansion coefficient curve is mild below 200° C., prevents an abrupt thermal expansion of the mold during heating, when it is employed together with quartz and cristobalite, and thereby prevents development of cracks. However, tridymite is not effective if its proportion is less than 5 % by weight, and, on the contrary, if its proportion is over 20% by weight, shortage of overall thermal expansion of the mold is resulted, rendering the offset insufficient against the contraction of the metal during casting.

In addition, as magnesium silicate, thermal expansion of which is linear with temperature, is employed in this invention, an abrupt thermal expansion is prevented during heating of the mold as in the case with tridymite, thereby preventing the development of cracks. However, if its proportion is less than 2% by weight, it is too small an amount to be effective, and, on the contrary, if its proportion is over 20% by weight, shortage of overall thermal expansion of the mold is resulted.

Furthermore, a small amount of aluminous cement employed in the present invention reduces expansion of the mold during hardening and thus prevents deformation of the mold, thus allowing precision casting by making full use of the merit of the thermal expansion as mentioned above. However, if the proportion of aluminous cement is less than 0.05% by weight, shortage of reduction of expansion during hardening is resulted, and, on the contrary, if its proportion is over 3% by weight, it causes a contraction of the mold at 100°–200° C. during heating and thereby resulting in a reduction of expansion during heating and, furthermore, causing cracks during heating.

Preferred proportion of ingredients other than the above-mentioned tridymite, magnesium silicate and aluminous cement to the total amount of the investing material, is 2–8% by weight for primary ammonium phosphate, 2–8% by weight for magnesium oxide (including magnesia clinker). When the proportion of primary ammonium phosphate or magnesium oxide is less than 2% by weight, hardening of the investing material becomes insufficient, and, on the contrary, if the proportion exceeds 8% by weight, shortage of thermal expansion during heating is resulted.

As for the remaining ingredients, quartz and cristobalite, the proportion when only one of them is used alone is preferably not less than 60% by weight, and more preferably, not less than 70% by weight. A proportion lower than 60% by weight results in shortage of expansion during heating. While either of quartz or cristobalite may be employed alone, it is preferred to use both of them together, which gives greater benefit both in prevention of cracks and reduction of expansion during hardening. Where used together, it is preferable that the respective proportion of quartz and cristobalite is not less than 10% by weight, with their sum being not less than 60% by weight, particularly not less than 70% by weight. When either of then is less than 10% by weight, advantage of their combined use is not obtained. For example, cracks becomes liable to occur when the amount of quartz is less than 10% by weight, while reduction of expansion during heating is resulted when the amount of cristobalite is less than 10% by weight.

Therefore, in a preferred embodiment of the present invention, 5–20% by weight tridymite, 2–20 by weight of magnesium silicate, 0.05–3% by weight of aluminous cement, 2–8% by weight of primary ammonium phosphate, 2–8 % by weight of magnesium oxide, 10–75% by weight of quartz and 10–75% by weight of cristobalite are admixed, and to this is added a colloidal silica suspension containing 10–40% silica, at a ratio of 20 ml per 100 g of the mixture, and then kneaded. The material composed of thus limited proportions of ingredients provides a better combination among expansion during hardening, expansion during heating and heating rate, and therefore allows easy handling, thus making itself more useful.

Separately from above, a wax pattern of, for example, a crown is planted to stand on a rubber crucible former by means of a sprue wire, and a pipe-like casting ring is stood on the crucible former so as to surround the wax pattern. The kneaded investing material prepared above is poured into the interior of the ring and left to stand to allow hardening for 60 minutes. The investing material thus hardened (mold) is removed from the rubber crucible former with the casting ring and put into an electric furnace, and the temperature in the electric furnace is elevated from the ambient temperature at a heating rate of 350° C./hr, and kept at 800° C. for 30 minutes to thereby melt and incinerate the wax pattern. After this, an alloy is melted and used for casting.

EXAMPLES

Tridymite, magnesium silicate, aluminous cement, primary ammonium phosphate, magnesium oxide, quartz and cristobalite were admixed in accordance with the respective proportions (parts by weight) of the different compositions as shown in the following table. 100 g each of the respective mixtures thus obtained was added with 20 ml of a colloidal silica suspension containing silica at a concentration of 30%, and kneaded in a vacuum kneaded at a rotation speed of 300 rpm. For these kneaded materials, rate of expansion during hardening, rate of expansion during heating and strength was respectively measured. The results are shown in the table. These kneaded materials were used to invest a wax pattern of a crown, heated in an electric furnace at a heating rate of 350° C./hr to thereby melt and incinerate the wax pattern, and then used to cast a crown of a gold alloy, in accordance with the method described in the section, "EMBODIMENT OF THE INVENTION". Development of cracks during heating and allowability of deformation of the cast (a crown) was visually examined. The results are also shown in the table.

In the above, rate of expansion during hardening and rate of expansion during heating were measured, respectively, in accordance with the report by Hidekazu Fudemoto, "Deformation occurring in casts resulted from the use of an expansion-free investing material made for trial", the Journal of Prosthetics, Vol. 24(2), p.165–185 (1980). Strength was measured in accordance with the method of JIS-T6601, "Investing Material for Dental Casting". Abbreviations used are: "Parts" for "Parts by weight", "Ex." for "Example" and "Comp." for "Comparing Example".

TABLE

| | Ex. 1 | Ex. 2 | Ex. 3 | Comp. 1 | Comp. 2 | Comp. 3 |
|---|---|---|---|---|---|---|
| Proportions (Parts) | | | | | | |
| Tridymite | 10 | 10 | 10 | — | 10 | 10 |
| Magnesium silicate | 5 | 5 | 5 | 5 | — | 5 |
| Aluminous cement | 1 | 1 | 1 | 1 | 1 | — |
| Primary ammonium phosphate | 5 | 5 | 5 | 5 | 5 | 5 |
| Magnesium oxide | 5 | 5 | 5 | 5 | 5 | 5 |
| Quartz | 44 | 74 | — | 44 | 44 | 44 |
| Cristobalite | 30 | — | 74 | 40 | 35 | 31 |
| Physical properties | | | | | | |
| Rate of expansion (%) during hardening | 0.1 | 0.2 | 0.3 | 0.2 | 0.2 | 1.2 |
| Rate of expansion (%) during heating | 1.5 | 1.3 | 1.7 | 1.5 | 1.5 | 1.5 |
| Strength (kg/cm$^2$) | 150 | 140 | 120 | 140 | 150 | 140 |
| Development of cracks during heating | no | no | no | yes | yes | no |
| Product deformation, allowable | yes | yes | yes | — | — | no |

As evident from the above table, Examples 1–3 showed only limited rates of expansion of not more than 0.3% while showing significant rates of expansion during heating of not less than 1.3%, and showed no development of cracks during heating and no substantial deformation of product during casting, thus providing products with high precision. In particular, Example 1, which employed the three types of silica together as heat resistant material, i.e. quartz, cristobalite and tridymite, exhibited minimum expansion during hardening while exhibiting maximum strength, thereby excelled in prevention of cracking and precision of the product. In contrast, Comparative Example 1, which lacked tridymite, and Comparative Example 2, which lacked magnesium silicate, both developed cracks during heating, rendering casting impossible. Similarly, Comparative Example 3, which lacked aluminous cement, showed increased rate of expansion during hardening and thus caused deformation of the mold, rendering the product unacceptable.

What is claimed is:

1. A dental investing material consisting essentially of:

| | |
|---|---|
| tridymite | 5–20 wt. % |
| magnesium silicate | 2–20 wt. % |
| aluminous cement | 0.05–3 wt. % |
| primary ammonium phosphate | 2–8 wt. % |
| magnesium oxide | 2–8 wt. % |
| quartz or cristobalite or both | the balance. |

2. The dental investing material according to claim 1, wherein not less than 60 wt. % of either quartz or cristobalite is contained.

3. The dental investing material according to claim 2, wherein not less than 70 wt. % of either quartz or cristobalite is contained.

4. The dental investing material according to claim 1, wherein not less than 10 wt. % of each of quartz and cristobalite are contained in combination and wherein the combined amount of quartz and cristobalite is not less than 60 wt. %.

5. The dental investing material according to claim 4, wherein said combined amount of quartz and cristobalite is not less than 70 wt. %.

* * * * *